US007131500B2

(12) United States Patent
Jomphe

(10) Patent No.: US 7,131,500 B2
(45) Date of Patent: Nov. 7, 2006

(54) SPORTS SURFACE RECONDITIONER

(76) Inventor: Julien Jomphe, 1323 boul. Franquet, Chambly, QBC (CA) J3L 2P8

( * ) Notice: Subject to any disclaimer, the term of this patent is extended or adjusted under 35 U.S.C. 154(b) by 192 days.

(21) Appl. No.: 10/752,699

(22) Filed: Jan. 8, 2004

(65) Prior Publication Data

US 2004/0140107 A1 Jul. 22, 2004

Related U.S. Application Data

(60) Provisional application No. 60/438,761, filed on Jan. 9, 2003.

(51) Int. Cl.
*A01B 45/00* (2006.01)

(52) U.S. Cl. ..... 172/49.5; 172/111; 172/21

(58) Field of Classification Search ..... 172/48, 172/49.5, 59, 110, 111, 125, 21, 22
See application file for complete search history.

(56) References Cited

U.S. PATENT DOCUMENTS

| | | | | |
|---|---|---|---|---|
| 2,050,120 | A * | 8/1936 | Pizarro | 172/56 |
| 2,732,783 | A * | 1/1956 | Murphy | 172/56 |
| 3,247,812 | A * | 4/1966 | Luciano et al. | 111/162 |
| 3,260,254 | A * | 7/1966 | Collins | 125/5 |
| 4,188,696 | A * | 2/1980 | Collins et al. | 29/81.05 |
| 4,232,743 | A * | 11/1980 | Steketee | 171/55 |
| 4,634,188 | A * | 1/1987 | Persson | 299/40.1 |
| 4,646,473 | A * | 3/1987 | Hundebol | 451/41 |
| 5,218,732 | A | 6/1993 | Pettigrew | |
| 5,274,962 | A * | 1/1994 | Hundebol | 451/28 |
| 5,468,173 | A * | 11/1995 | Winton, III | 451/59 |
| 5,562,779 | A | 10/1996 | Allaway | |
| 5,951,780 | A | 9/1999 | Pettigrew | |
| 5,980,371 | A * | 11/1999 | McConnell | 451/352 |

FOREIGN PATENT DOCUMENTS

| | | |
|---|---|---|
| DE | 198 34 848.7 A1 | 4/1999 |
| JP | 10008414 A | 1/1998 |

* cited by examiner

*Primary Examiner*—Thomas B. Will
*Assistant Examiner*—Alexandra Pechhold
(74) *Attorney, Agent, or Firm*—Franz Bonsang, Patent Agent; Protections Equinox

(57) ABSTRACT

A device for reconditioning a damaged sports surface. The device includes at least one rotatably driven shaft with two ends, one of which is connected to a frame, the other end being disposed towards the surface. The driven shaft is disposed orthogonal relative to the surface. A work head is connected to the shaft and is in contact with the surface. The work head is rotated by the shaft relative to the surface and reconditions the surface. A mobile device is disclosed.

32 Claims, 8 Drawing Sheets

SPORTS SURFACE RECONDITIONER

CROSS-REFERENCE TO RELATED APPLICATION

Priority of U.S. Provisional Application No. 60/438,761, filed on Jan. 9, 2003, is hereby claimed.

FIELD OF THE INVENTION

The present invention concerns artificial sports surfaces and more particularly to devices for reconditioning the surfaces.

BACKGROUND OF THE INVENTION

Artificial sports surfaces such as artificial turf are well known and widely used as alternatives to natural grass surfaces. Artificial turf includes a mat into which are woven an array of naps that project upwardly and cover the mat, thereby providing cushioning and grip to the sports players. Often sand is added to the artificial turf and is worked into the area between the naps. During use, the naps are often flattened, thereby losing their cushioning and gripping properties, and may be embedded in the sand. The artificial surfaces must, therefore, be maintained to prevent deterioration. To maintain the surfaces and thereby extend their useful life, the naps must be returned to their original upright state and the sand scarified to prevent compaction. To achieve this, several designs of reconditioning device have been used, a few examples of which are illustrated below:

- U.S. Pat. No. 5,218,732, issued Jun. 15, 1993, to Pettigrew for "Surface Treatment Apparatus";
- U.S. Pat. No. 5,562,779, issued Oct. 8, 1996, to Allaway for "Device and Method for Cleaning Particulate Material"; and
- U.S. Pat. No. 5,951,780, issued Sep. 14, 1999, to Pettigrew for "Surface Treatment Method and Apparatus including Brush Means and Impact Means mounted on a Single Shaft".

The above-mentioned designs, however, suffer from a number of important disadvantages. One design appears to disclose a moving jet of air that dislodges particulate material from a sports surface and removes it into a manifold. This design may not be suitable to recondition sports surfaces by regenerating the surface components. Pettigrew's designs, while used for reconditioning artificial surfaces, appear to require a drive system to power a series of brushes, scarifying elements and swing hammers. Disadvantageously, spaces between the reconditioning components significantly reduce the effective area that is accessible to the components.

Most existing devices remove part of the aerated sand away from the surface along with undesired particulate debris, thereby requiring new sand to be deposited on and spread over the surface after reconditioning.

Thus there is a need for an improved sports surface reconditioning device.

SUMMARY OF THE INVENTION

It is therefore a general object of the present invention to provide an improved sports surface reconditioning device.

The invention reduces the difficulties and disadvantages of the prior art by providing a reconditioning device for artificial sports surfaces that can be quickly and easily retrofitted onto an existing vehicle such as a golf cart or lawn mower. Advantageously, the device enables surface areas to be reconditioned gently and quickly by straightening up flattened naps in artificial turf that may be embedded in a layer of sand. The device also aerates and scarifies the rubber and/or the sand surface between the naps over an adjustable pre-determined depth. Moreover, the device can be easily adapted to allow particulate debris such as soil, leaves, fungi and the like to be swept up and captured or moved away from the travel path of the device by adding of a vacuum or blower system. Furthermore, the device provides a series of vertically rotating work heads with freely rotating sprockets, which are arranged in a pattern so that the aforesaid problem of reduced surface area covered, is significantly reduced or essentially eliminated. The device may also advantageously provide for efficient reconditioning of surfaces that are adjacent fencing or along edges of the sports surface. In addition, the work heads in operation provide a whipping action that reconditions the surface without completely removing the layer of sand between the naps. The device, while used effectively for napped surfaces may also be used to recondition sports surfaces such as clay and the like.

According to a first aspect of the present invention, there is provided a device for reconditioning a damaged sports surface, the device comprising; at least a first group of three rotatably driven shafts, each driven shaft having a first end and a second end, the first end being connected to a frame and the second end being disposed towards the surface, each driven shaft being disposed orthogonal relative to the surface, the frame including a first longitudinal beam to which one driven shaft of the first group is connected, a second longitudinal beam to which two spaced apart driven shafts of the first group are connected, and two side beams being connected to the first and second longitudinal beams to define a work space therebetween; and for each driven shaft, a work head connected to the second end thereof and rotated relative to the surface by the driven shaft, the work head having at least one surface contact wheel freely and independently rotatably connected thereto for contact with the surface so as to recondition the surface.

Typically, the work head includes at least two work head shafts connected to the second end of the driven shaft. Preferably, the work head includes three work head shafts connected to the second end of the driven shaft. The work head shafts are radially disposed and equidistant from each other.

Typically, each of the work head shafts include at least one surface contact wheel freely rotatably connected to a shaft end portion. Preferably, each of the work head shafts include two spaced apart surface contact wheels that are freely and independently rotatably connected to the shaft end portions.

Typically, the driven shaft has a generally vertical axis of rotation and the surface contact wheels each have an axis of rotation generally orthogonal to the axis of rotation of the driven shaft.

Typically, the surface contact wheels include a plurality of circumferentially disposed teeth. Preferably, the teeth have smooth rounded edges.

In addition to the first group, the frame includes a second group of three driven shafts adjacent the first group, the second group including two spaced apart driven shafts connected to the first longitudinal beam and one driven shaft connected to the second longitudinal beam. Preferably, the frame includes a third group of three driven shafts adjacent the second group, the third group being arranged the same as the first group.

Preferably, the first, second and third groups of driven shafts are disposed such that their respective work heads are arranged in alternating triangular patterns. The driven shafts are coaxial and are driven in opposite directions.

Typically, the driven shafts are driven by a drive mechanism connected to an upper part of the frame. The drive mechanism includes: a main drive wheel connected to a pinion wheel, each being connected to a drive wheel shaft, the drive wheel shaft being connected to the frame; a drive wheel connected to the first end of each driven shaft, the first end being rotatably connected to their respective longitudinal beams; a belt interconnecting each of the drive wheels to the pinion wheel; and a prime mover connected the main drive wheel to drive the drive mechanism. Preferably, an extension member is connected to the frame, the extension member having therein a slot, the drive wheel shaft being adjustably mounted in the slot so as to adjust the position of the drive wheel shaft relative to the frame.

Typically, the frame further includes four wheels rotatably connected to a crank mechanism, the crank mechanism being operable to retract or extend the wheels relative to the sports surface so as to move the work heads relative to the sports surface. The frame is connected to a front portion of a wheeled vehicle, the vehicle being movable across the sports surface.

Typically, the sports surface is an artificial surface. Preferably, the artificial surface is artificial turf. Preferably, the artificial surface is clay.

BRIEF DESCRIPTION OF THE DRAWINGS

Further aspects and advantages of the present invention will become better understood with reference to the description in association with the following Figures, wherein.

DETAILED DESCRIPTION OF THE PREFERRED EMBODIMENTS

Figure 1:
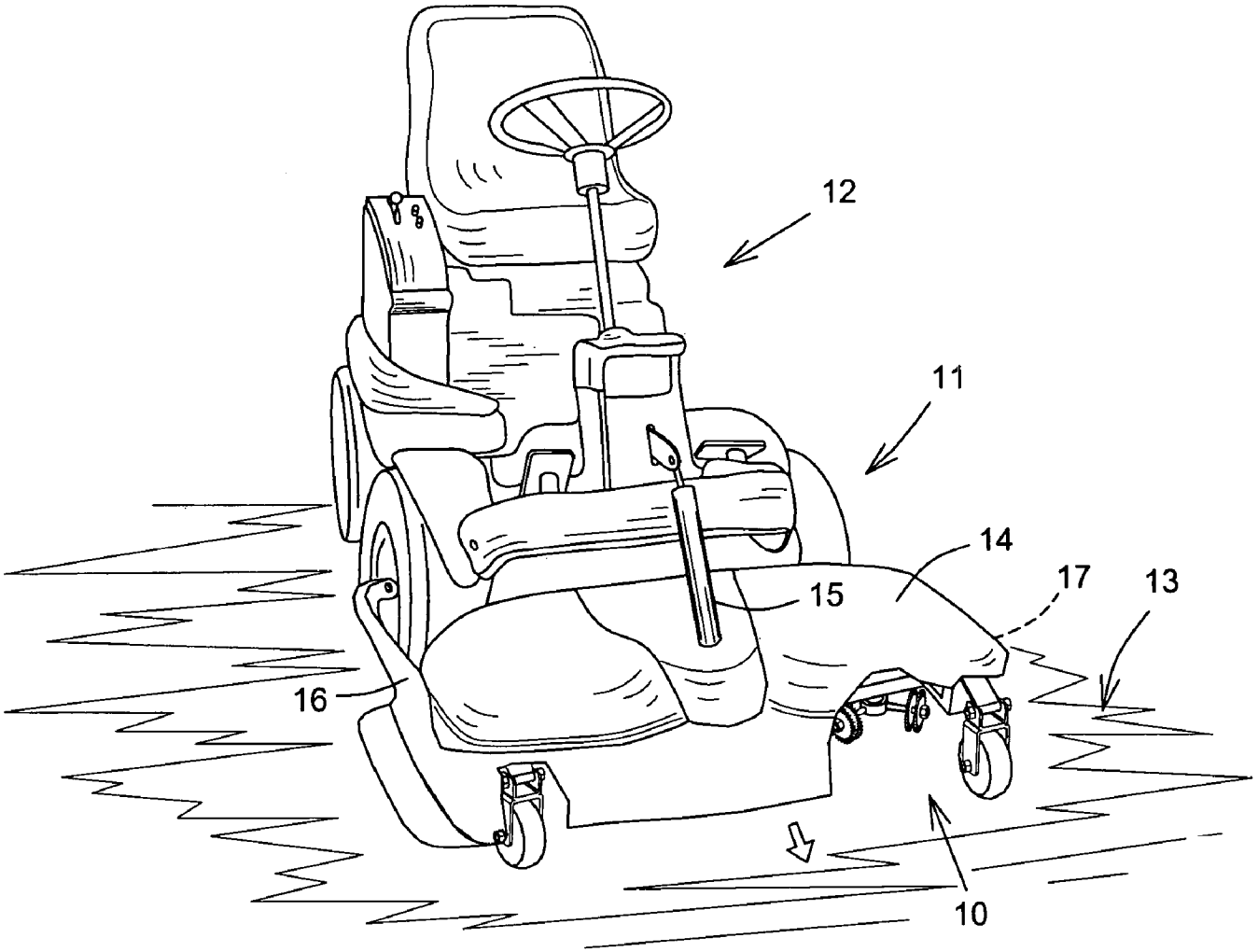
FIG. 1 is a perspective view of an embodiment of a reconditioning device of the present invention connected to a vehicle.
Figure 2:
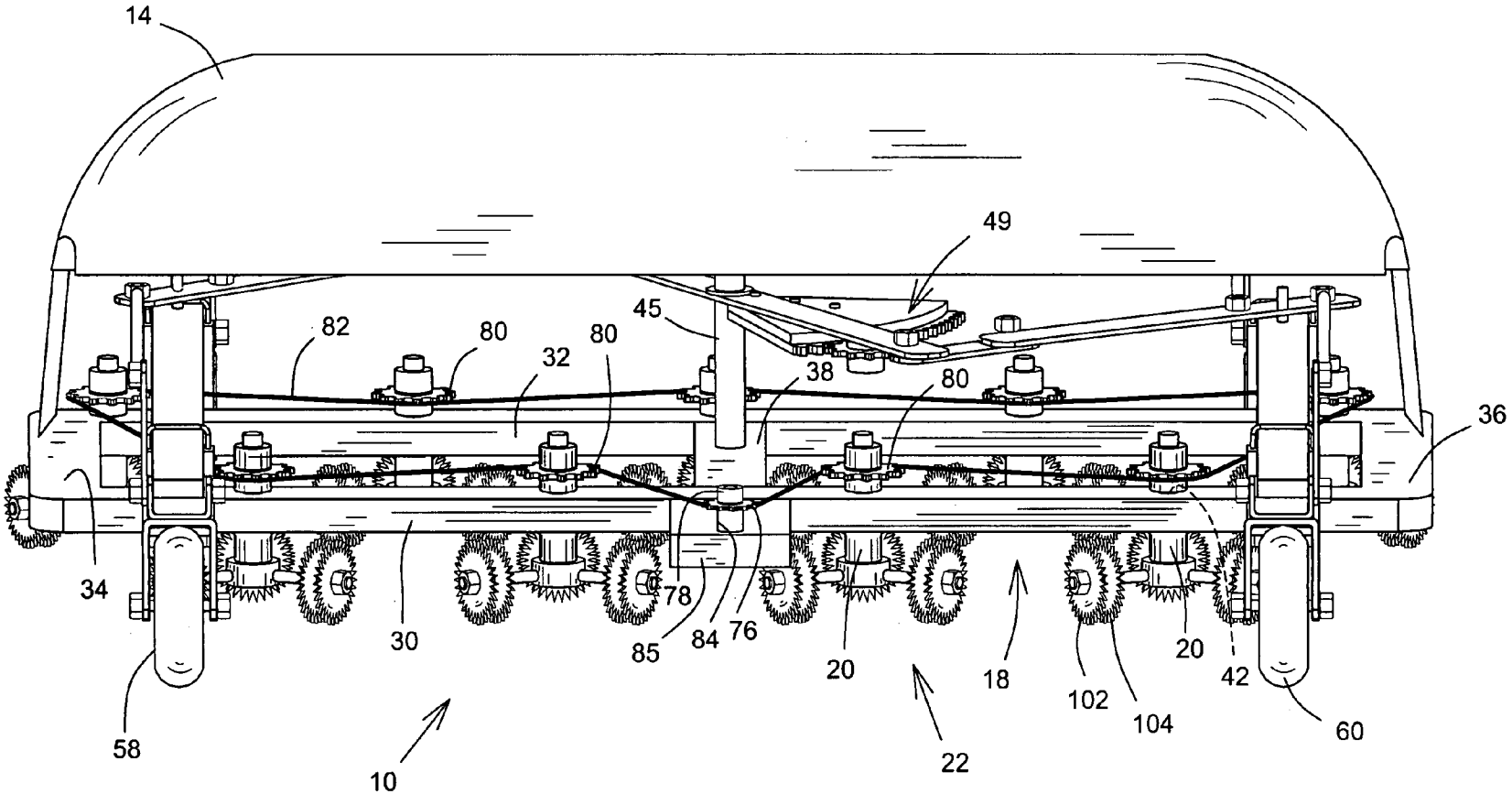
FIG. 2 is a simplified front perspective view of the vehicle showing the reconditioning device.

Referring to now to FIG. 1, there is shown a reconditioning device 10 in accordance with an embodiment of the present invention. The device 10 is shown connected to a front end 11 of a vehicle 12 for reconditioning a sports playing surface 13. A retractable cover 14 acts as a safety guard for the device 10 and allows easy access thereto for routine maintenance. Typically, a hydraulic piston 15 connects the cover 14 to the front end 11 and is operable from the vehicle 12 by an operator sitting in the vehicle 12. A pair of side arms 16, 17 removably connect the device 10 to the front wheels of the vehicle 12. Although the device 10 is shown as being used with a converted lawn mower 12 for reconditioning a specific type of artificial surface, such as artificial turf, it should be understood that the device 10 could be used with any type of vehicle, and on any type of artificial surface, such as a clay, without deviating from the scope of the invention.

Furthermore, as used herein, the term "sports playing surface" is intended to mean a surface on which sports are played and include football fields, tennis courts, hockey fields, golf courses and the like, without deviating from the scope of the invention.

Also, as used herein, the term "damaged sports surface" when referring to napped surfaces is intended to mean that the naps are flattened such that they lie away from the vertical plane and may be embedded into a compacted matrix composed of sand and/or rubber particulates or, when referring to case of clay surfaces, is intended to mean a damp patch of clay that is compacted. The term "reconditioning" or "reconditioned", when referring to the sports surface, is intended to mean straightening up of naps, scarifying or uncompacting at least an upper portion of the sand layer located between the naps or compacted clay.

Furthermore, although the present invention is exemplified as being used specifically in the context of artificial sports playing surfaces, it should be understood that some or all of the characteristics of the present invention could be used for other surface reconditioning situations including natural grass surfaces, walkways, indoor carpets and the like, without deviating from the scope of the invention.

Referring now to FIGS. 1, 2, 3, and 6, broadly speaking, the device 10 of the present invention includes a frame 18, at least one rotatably driven shaft 20 and a work head 22. Preferably, three shafts 20 are arranged in a first group 24 and connected to the frame 18. More preferably, a second group 26 of three shafts 20 connected to the frame 18 and located adjacent the first group 24. Even more preferably, a third group 28 of three shafts 20 connected to the frame 18 and located adjacent the second group 26.

The frame 18 is typically made of rigid material such as stainless steel and includes a first longitudinal beam 30, which is disposed frontwardly of the vehicle 12, a second longitudinal beam 32, which is disposed frontwardly of the beam 30 and two side beams 34, 36, which are connected together to form a general rectangular shaped frame. A central beam 38 is connected between the two longitudinal beams 30, 32, the beams defining a workspace 40 therebetween. The longitudinal beams 30, 32 include a number of holes 42 that are used to mount therein the driven shafts 20. The frame 18, when connected to the vehicle 12 lies in a general horizontal plane relative to the sports surface 13. Although the frame 18 illustrated is a rigid rectangle, it should be understood that any shape of frame could be used without deviating from the scope of the invention.

Figure 3:
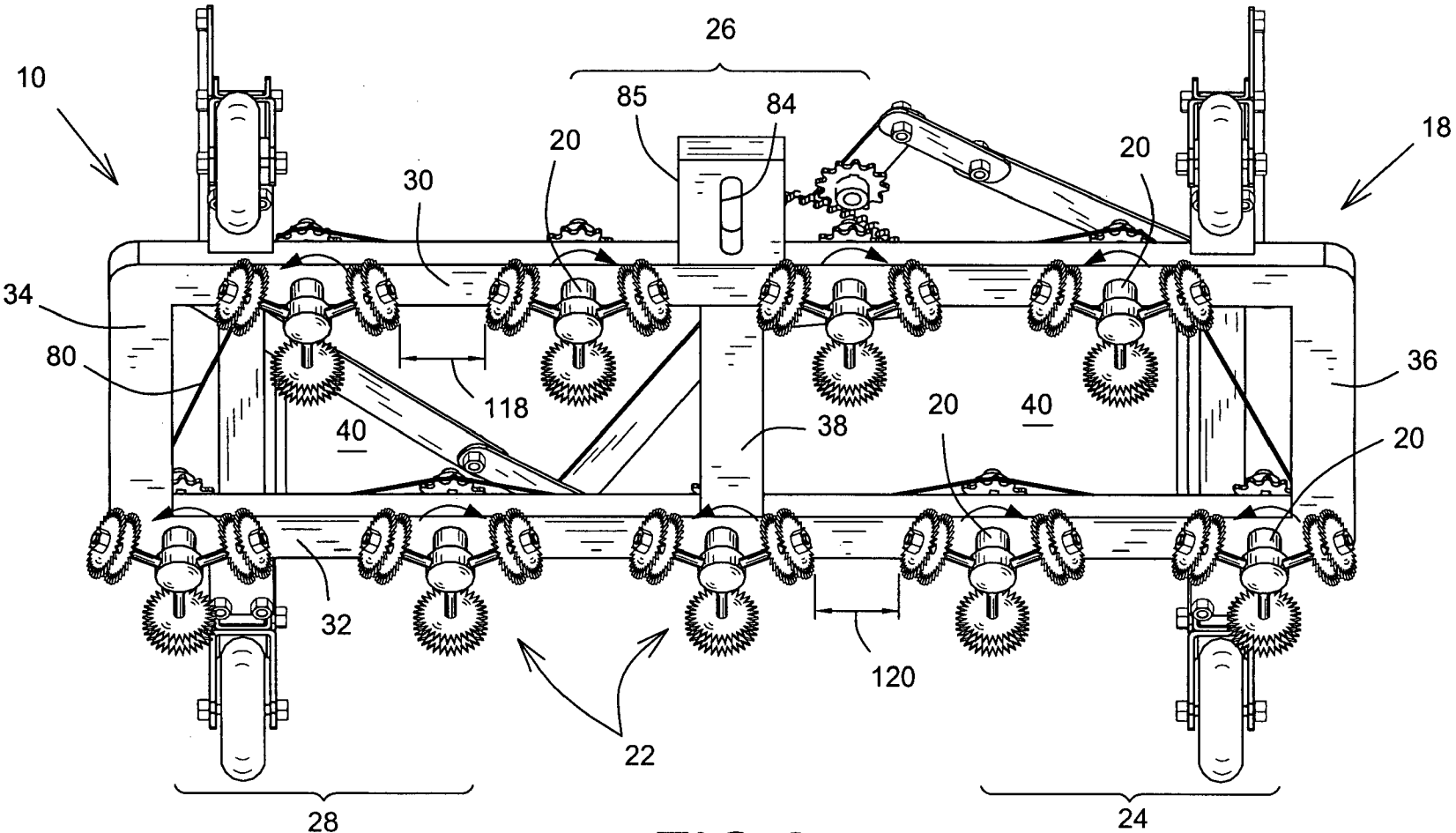
FIG. 3 is a simplified worm's eye view of the reconditioning device.
Figure 7:
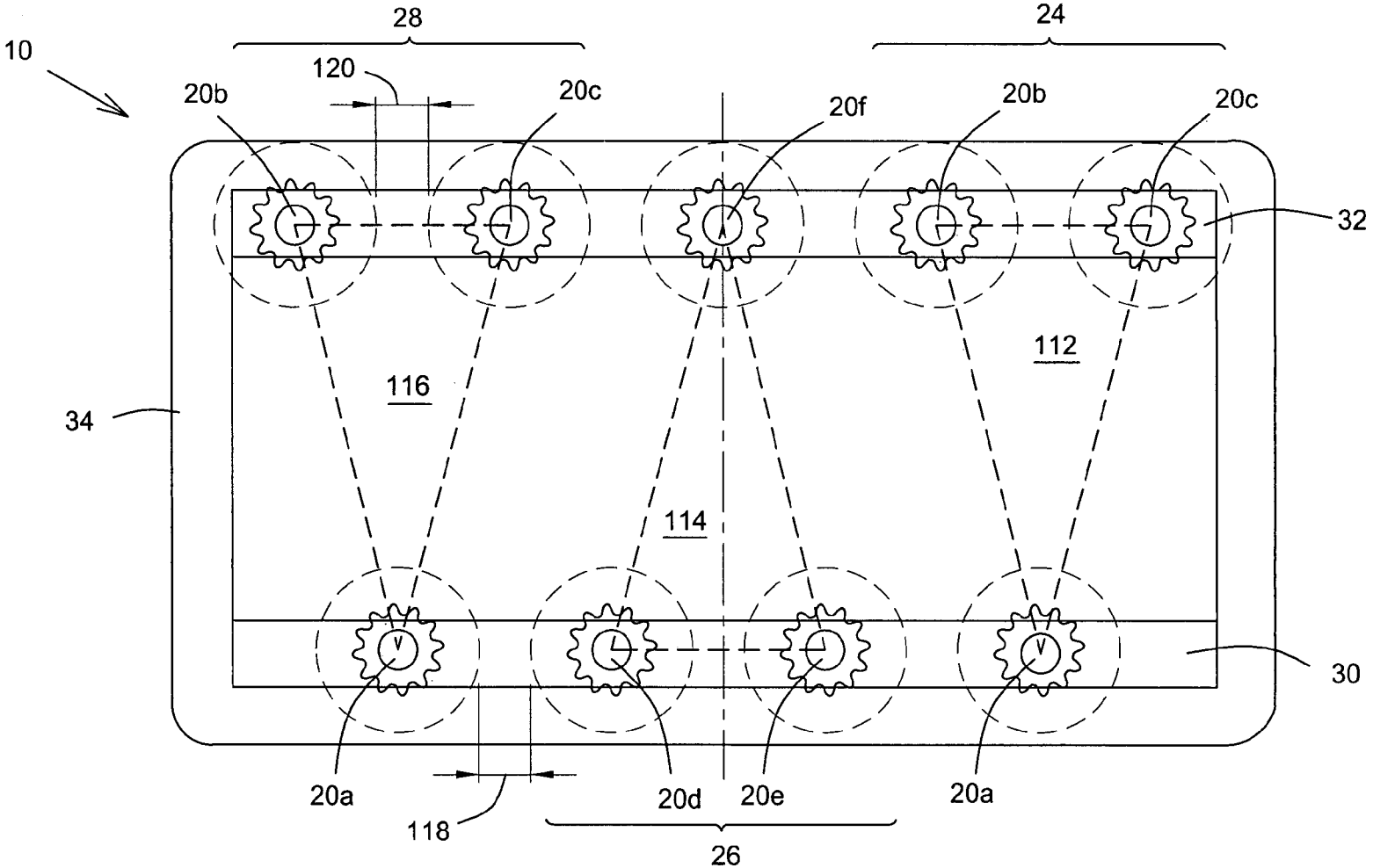
FIG. 7 is a schematic representation of atop view of a pattern of a number of work heads.

As best illustrated in FIGS. 3 and 7, the first group 24 of three driven shafts 20 includes one driven shaft 20*a* connected to the first longitudinal beam 30 and two spaced apart driven shafts 20*b*, 20*c* connected to the second longitudinal beam 32. The second group 26 of three driven shafts 20, located adjacent the first group 24, includes two spaced apart driven shafts 20*d*. 20*e* connected to the first longitudinal beam 30 and one driven shaft 20*f* connected to the second longitudinal beam 32. The third group 28 of three driven shafts 20, adjacent the second group 28, are arranged the same way as the first group 24.

The first, second and third groups 24, 26, and 28 of the driven shafts 20 are all coaxial arranged and disposed such that their respective work heads 22 are arranged in alternating triangular patterns, the significance of which will be described below.

Figure 5:
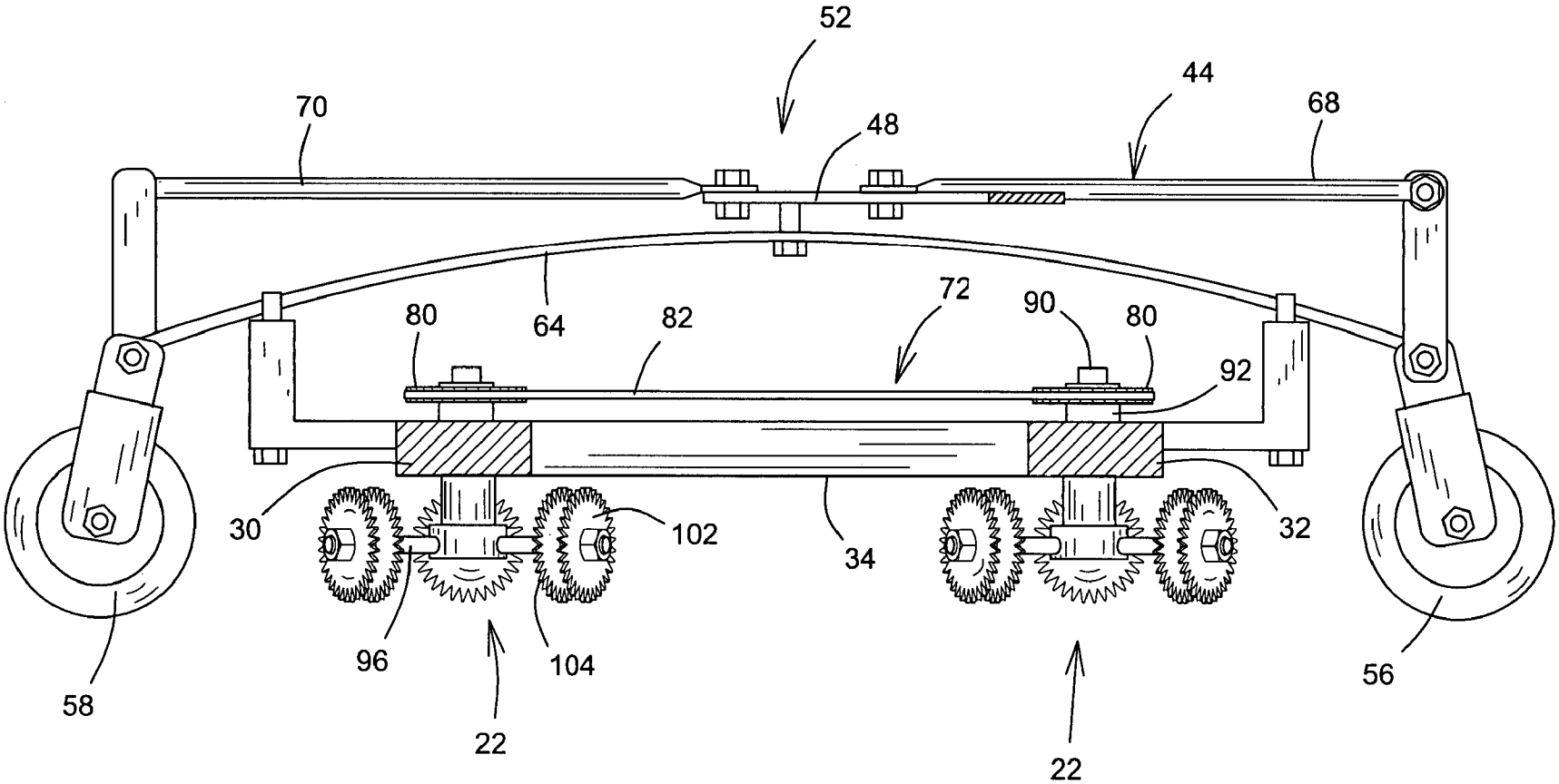
FIG. 5 is a simplified side view of the reconditioning device.
Figure 6:
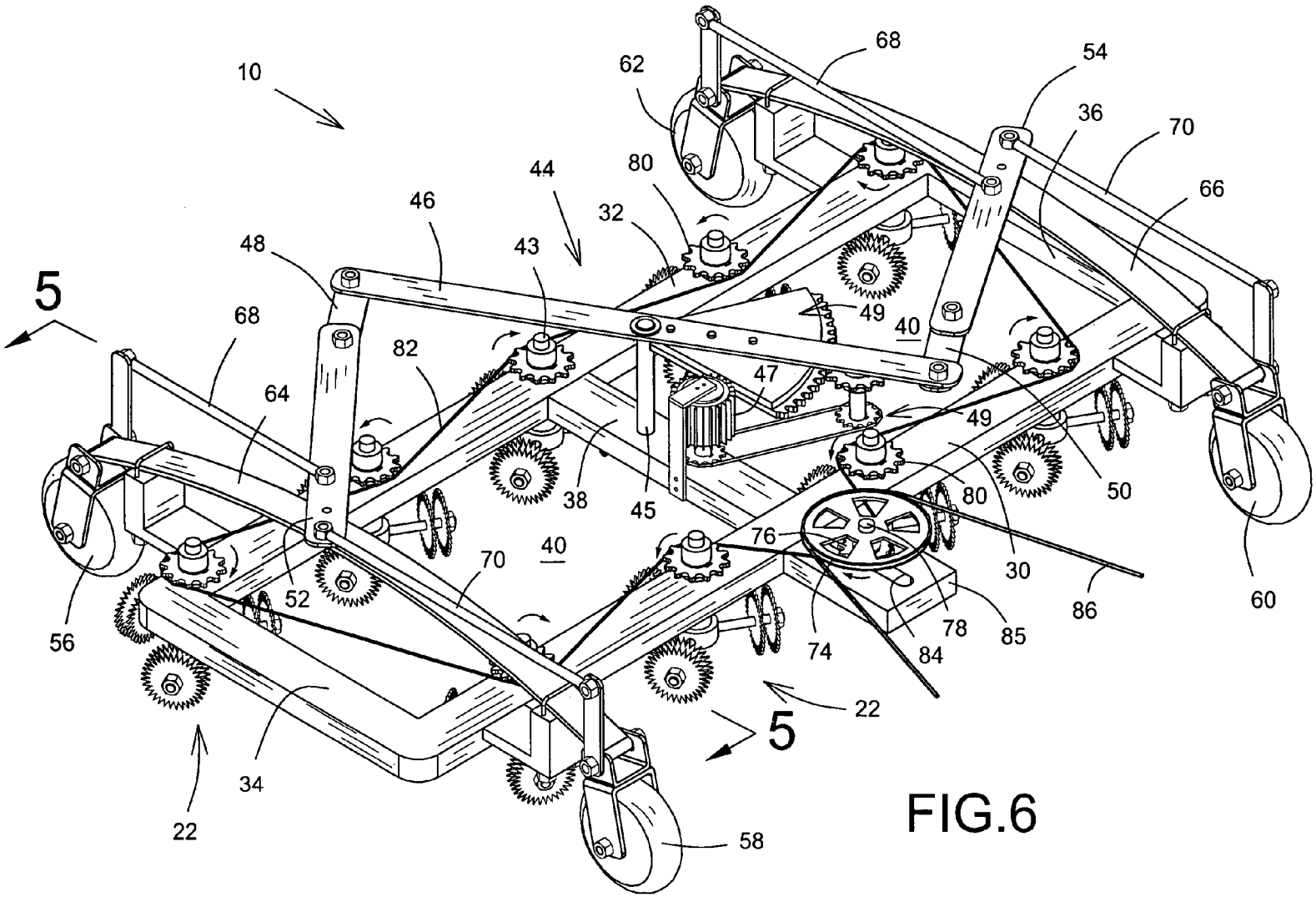
FIG. 6 is an elevation top view of the reconditioning device.

Referring now to FIGS. 5 and 6, the frame 18 includes a crank mechanism 44 that is mounted to an upper part of the frame 18. A central post 45 is rotatably connected to the central beam 38 from which extend two hinged crank arms 48, 50 via a transfer arm 46 transversally secured to the central post 45. The central post 45 is typically rotatably actuated by an electric motor 47 or the like mounted on the frame 18 and connected to the central post 45 via a gear-belt assembly 49. Each of the crank arms 48, 50 includes a connector end 52, 54. Two pairs of wheels 56, 58, 60, 62 are rotatably connected to arched supports 64, 66 that are connected to the connector end 52, 54. Each wheel 56, 58, 60, 62 is movably connected to two hinged crank arms 68, 70, which when operated by the operator, move the wheels 56, 58, 60, 62 towards or away from the sports surface 13 and simultaneously moves the work heads 22 towards and away from the sports surface 13. The wheels 56, 58, 60, 62 typically have a wide wheel base for engagement with the sports surface 13 in order to significantly reduce or essentially eliminate wear of the latter when in contact therewith, especially during turning maneuvers.

A common drive mechanism 72 is connected to the upper part of the frame 18 and is used to, drive the driven shafts 20. Preferably, the common drive mechanism 72 includes a main drive wheel 74 connected to a pinion wheel 76. Both the main drive wheel 74 and the pinion wheel 76 are typically connected to a main drive wheel shaft 78. The main drive wheel shaft 78 is typically adjustably mounted on a transversal slot opening 84 of an extension 85 connected to the frame 18 extending generally rearwardly from the first longitudinal beam 30. A drive wheel 80 is connected to each of the driven shaft 20. A drive belt or preferably chain 82 interconnects each of the drive wheels 80 to the pinion wheel 76. The positioning adjustment of the main drive wheel shaft 78 within the slot opening 84 allows for adjustment of the tension in the drive chain 82, enhanced driving of the chain 82 and easy assembly of the drive mechanism 72. The main drive wheel 74 is connected to a prime mover, typically the vehicle engine (not shown), by another drive belt 86 and a conventional clutch mechanism (not shown). The main drive wheel 74, when activated, drives the driven shafts 20 in opposite directions (as best shown by the arrows in FIG. 6) so that each work head 22 is rotated in opposite directions to that of the adjacent work heads. This opposing rotation of adjacent and work heads 22 located on the same beam, either beam 30 or beam 32, cause a whipping movement. The whipping movement provides a low speed vacuum or suction action between the work heads 22 to remove light weight debris such as leaves and the like covering the surface of and embedded within the upper portion of the compacted rubber/sand matrix, without damaging the naps, into which the naps are embedded or the sand surface.

Figure 4:
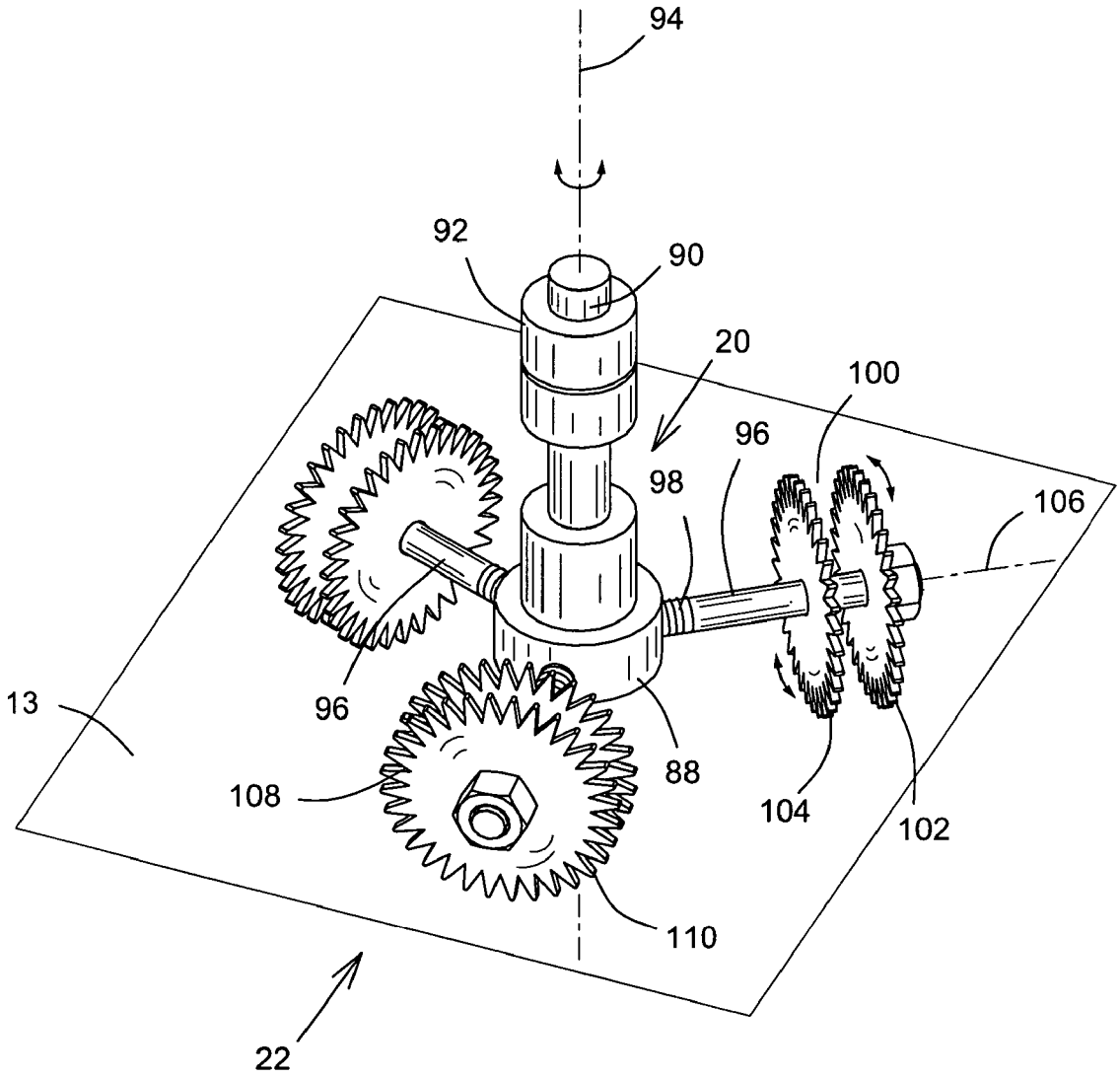
FIG. 4 is a simplified perspective view of a work head.

Since the driven shafts 20 are essentially identical, only one will be described in detail with reference to FIGS. 4 and 4*a*. The driven shaft 20 includes a first end 88, a second end 90 and the work head 22, which is connected to the first end 88. The second end 90 is mounted in one of the holes 42 in the beams 30, 32, by way of a bearing 92. The bearing 92 allows the driven shaft 20 unrestricted rotation in the hole 42. The shaft 20 is mounted such that, during operation of the device 10, it is disposed generally orthogonal to the sports surface 13 and rotates about a generally vertical axis 94 relative to the surface 13. The work head 22, connected to the first end 88 of the shaft 20, is orientated towards the surface 13, and is in contact with it during the operation of the device as the driven shaft 20 rotates about its axis 94.

The work head 22 includes three work head shafts 96, although two balanced work head shafts 96 would also work, that are connected to the first end 88 of the driven shaft 20. The three work head shafts 96 are radially disposed and equidistant from each other. Each work head shaft 96 includes a threaded end 98, which allows the shaft 96 to be removed from the first end 88 for routine maintenance, and an end portion 100.

Each work head shaft 96 includes at least one surface contact wheel 102 that is freely rotatably connected to the end portion 100. Preferably, each of the work head shaft 96 includes two spaced apart surface contact wheels 102, 104 that are freely and independently rotatably connected to the end portion 100. The surface contact Wheels 102, 104 have an axis of rotation 106 that is generally orthogonal to the axis of rotation 94 of the driven shaft 20 and generally parallel to the sports surface 13.

The surface contact wheels 102, 104 are connected to the end portion 100 using standard securing means such as bolts and the like. Each wheel 102, 104 includes an independent bearing (not shown) that allows the wheels 102, 104 to freely rotate independently of each other. The wheels 102, 104 include a plurality of circumferentially disposed teeth 108 that extend generally radially from the edge of the wheels 102, 104. To reduce damage to the surface 13, the teeth 108, since they are in contact with the sports surface 13 when the shaft 20 rotates, have smooth rounded edges 110. Typically, the smooth rounded edges 110 include the tip and side edges of the teeth. Although toothed wheels, such as sprockets, are illustrated, it will be understood that other designs of surface contact wheels or tooth configurations can be used without deviating from the scope of the present invention.

Referring now to FIG. 7, typically the first, second and third groups of work heads 24, 26, and 28 are arranged in alternating triangles 112, 114, 116 respectively (as shown by the broken lines). Each work head 22 in the work head groups 24, 26, and 28 is sized so that the area of the surface 13 under a first non-worked space 118, as shown between shafts 20*a* and 20*d*, is covered and reconditioned by the work head opposite the space 118, as shown by shaft 20*c*. Similarly, the area of the surface 13 under a second non-worked space 120, located between adjacent work heads 22, as shown between shafts 20*b* and 20*c*, is covered and reconditioned by the work head 22, as shown by shaft 20*a*.

One skilled in the art will recognize that work heads 22 may be mounted on the same beam, either the first longitudinal beam 30 or the second longitudinal beam 32 could be configured and sized to avoid the non-worked spaces 118, 120 by locating the work heads 22 close together in a linear arrangement.

Operation

Figure 4A:
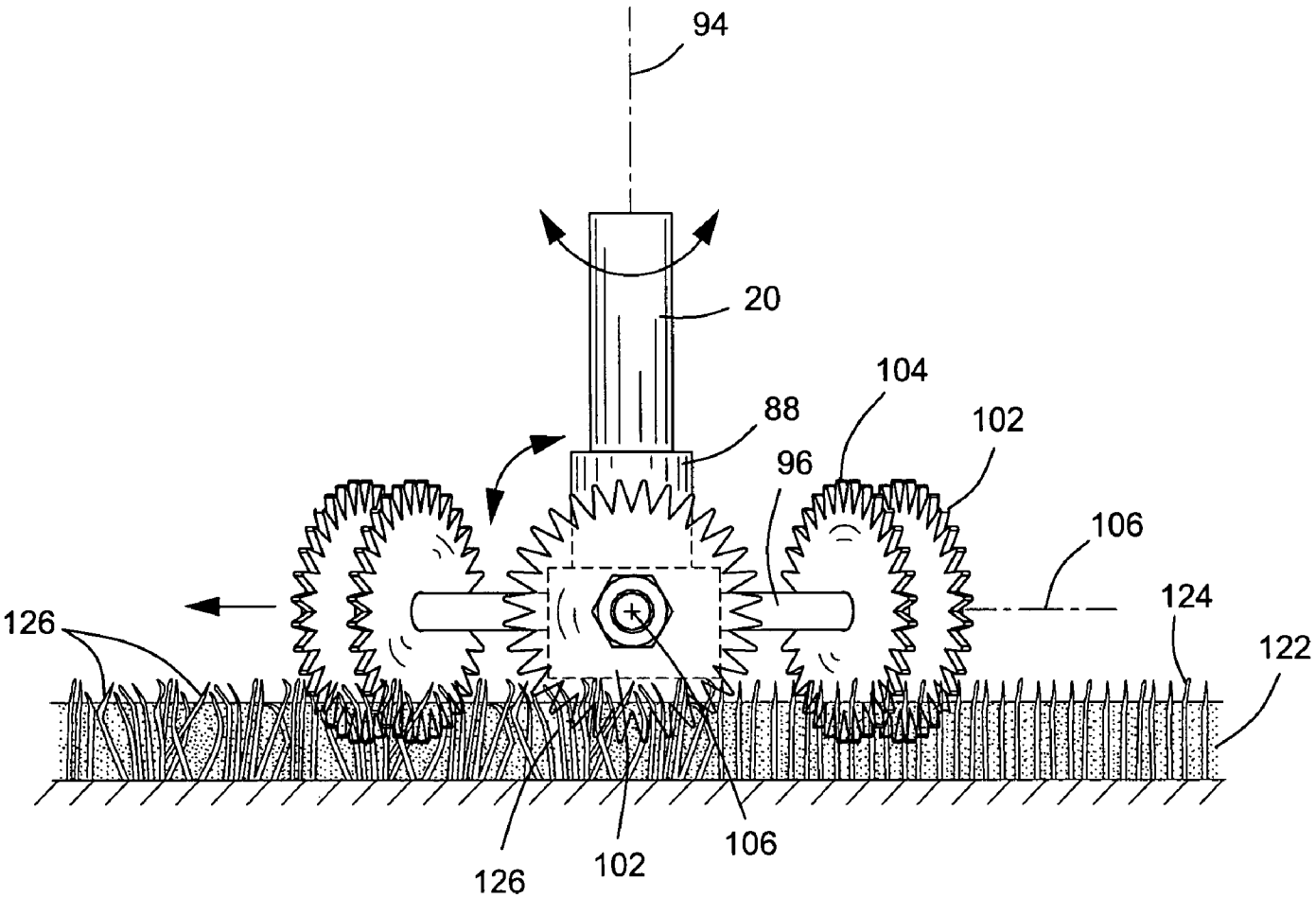
FIG. 4*a* is a simplified side view of the work head contacting an artificial turf surface.

Referring now to FIGS. 1, 4*a* and 7, a typical operation of the device 10 will now be described in which flattened naps 126 embedded into a compacted sand layer 122 of the sports surface 13, are straightened up to give reconditioned naps 124 with an aerated and scarified sand layer 122.

The operator drives the vehicle 12 onto the sports surface 13 and operates the crank mechanism 44 to engage the work heads 22 with the surface 13 by retracting the wheels 56, 58, 60, 62. The prime mover 84 is activated and the driven shafts 20 rotate orthogonal relative to the surface 13. The operator drives the vehicle 12 across the sports surface 13 so that the wheels 102, 104 of the work heads 22 sweep out different areas of the sports surface 13. At this time, the weight of the device 10 is supported by all of the wheels 102, 104 of each work head 22. As the vehicle 12 moves across the surface 13, the teeth 108 of the wheels 102, 104 frictionally contact the flattened naps 126 and the top sand layer 122 of the surface 13 so that the wheels 102, 104 freely rotate about their axes 106. This free rotation of the wheels 102, 104, induced by the movement of the vehicle 12 across the surface 13 and the rotation of the driven shafts 20, causes the flattened naps 126 to be straightened up from the sand layer 122 and the upper portion of the rubber mat or sandy layer 122 raked or scarified. Once the reconditioning operation is complete, or if another remote area of the surface 13 requires reconditioning, the operator may lower the wheels 56, 58, 60, 62 onto the surface 13 and drives the vehicle to the remote area.

One skilled in the art will recognize that the crank mechanism 44 further allows for height adjustment of the surface contacting wheels 102, 104 relative to the sports surface 13 being reconditioned with the wheels 56, 58, 60, 62 being partially retracted from the surface 13 to partially support the weight of the device 10. In this configuration, the operator substantially controls the working depth of the contacting wheels 102, 104 into the upper portion of the sand layer 122.

While a specific embodiment has been described, those skilled in the art will recognize many alterations that could be made within the spirit of the invention, which is defined solely according to the following claims.

I claim:

1. A device for reconditioning a damaged sports surface, the device comprising;

at least a first group of three rotatably driven shafts, the shafts driven by a drive mechanism, each driven shaft having a first end and a second end, the first end being connected to a frame and the second end being disposed towards the surface, each driven shaft being disposed orthogonal relative to the surface, the frame including a first longitudinal beam to which one driven shaft of the first group is connected, a second longitudinal beam to which two spaced apart driven shafts of the first group are connected, and two side beams being connected to the first and second longitudinal beams to define a work space therebetween; and for each driven shaft, a work head connected to the second end thereof and rotated relative to the surface by the driven shaft, the work head having at least one surface contact wheel configured to contact the sports surface, the at least one surface contact wheel being freely and independently rotatably connected thereto for contact with the surface so as to recondition the surface.

2. The device, according to claim 1, in which the work head includes at least two work head shafts connected to the second end of the driven shaft.

3. The device, according to claim 2, in which the work head includes three work head shafts connected to the second end of the driven shaft.

4. The device, according to claim 3, in which the work head shafts are radially disposed and equidistant from each other.

5. The device, according to claim 4, in which each work head shaft includes a shaft end portion and each surface contact wheel is freely and independently rotatably connected to the work head on the shaft end portion of one of the work head shafts, each work head shaft including at least one surface contact wheel freely and independently rotatably connected upon the shaft end thereof.

6. The device, according to claim 5, in which each of the work head shafts include two spaced apart surface contact wheels that are freely and independently rotatably connected to the shaft end portions.

7. The device, according to claim 6, in which each driven shaft has a generally vertical axis of rotation and the surface contact wheels each have an axis of rotation generally orthogonal to the axis of rotation of the driven shaft.

8. The device, according to claim 7, in which the surface contact wheels include a plurality of circumferentially disposed teeth.

9. The device, according to claim 8, in which the teeth have smooth rounded edges.

10. The device, according to claim 1, in which the frame includes a second group of three driven shafts adjacent the first group, the second group including two spaced apart driven shafts connected to the first longitudinal beam and one driven shaft connected to the second longitudinal beam.

11. The device, according to claim 10, in which the frame includes a third group of three driven shafts adjacent the second group, the third group being arranged the same as the first group.

12. The device, according to claim 11, in which the first, second and third groups of driven shafts are disposed such that their respective work heads are arranged in alternating triangular patterns.

13. The device, according to claim 12, in which the driven shafts are coaxial and are driven in opposite directions.

14. The device, according to claim 13, in which the driven shafts are driven by the drive mechanism connected to an upper part of the frame.

15. The device, according to claim 14, in which the drive mechanism includes:

a main drive wheel connected to a pinion wheel, each being connected to a drive wheel shaft, the drive wheel shaft being connected to the frame;

a drive wheel connected to the first end of each driven shaft, the first end being rotatably connected to their respective longitudinal beams;

a belt interconnecting each of the drive wheels to the pinion wheel; and a prime mover connected the main drive wheel to drive the drive mechanism.

16. The device, according to claim 15, in which an extension member is connected to the frame, the extension member having therein a slot, the drive wheel shaft being adjustably mounted in the slot so as to adjust the position of the drive wheel shaft relative to the frame.

17. The device, according to claim 1, in which the frame further includes four wheels rotatably connected to a crank mechanism, the crank mechanism being operable to retract or extend the wheels relative to the sports surface so as to move the work heads relative to the sports surface.

18. The device, according to claim 17, in which the frame is connected to a front end of a wheeled vehicle, the vehicle being movable across the sports surface.

19. The device, according to claim 1, in which the sports surface is an artificial surface.

20. The device, according to claim 19, in which the artificial surface is artificial turf.

21. The device, according to claim 19, in which the artificial surface is clay.

22. A mobile device for reconditioning a damaged artificial sports surface, the device comprising;

a vehicle having a frame connected to a vehicle front end, the vehicle being movable across the surface;

at least a first group of three rotatably driven shafts, each driven shaft having a first end and a second end, the first end being connected to the frame and the second end being disposed towards the surface, each driven shaft being disposed orthogonal relative to the surface, the frame including a first longitudinal beam to which one driven shaft of the first group is connected, a second longitudinal beam to which two spaced apart driven shafts of the first group are connected, and two side beams being connected to the first and second longitudinal beams to define a work space therebetween; and for each driven shaft, a work head connected to the second end thereof and rotated relative to the surface by the driven shaft, the work head having at least one surface contact wheel configured to contact the sports surface, the at least one surface contact wheel being freely and independently rotatably connected thereto for contact with the surface so as to recondition the surface as the vehicle moves across the surface.

23. The device, according to claim 22, in which the frame includes a second group of three driven shafts adjacent the first group, the second group including two spaced apart driven shafts connected to the first longitudinal beam and one driven shaft connected to the second longitudinal beam.

24. The device, according to claim 23, in which the frame includes a third group of three driven shafts adjacent the second group, the third group being arranged the same as the first group.

25. The device, according to claim 24, in which the first, second and third groups of driven shafts are disposed such that their respective work heads are arranged in alternating triangular patterns.

26. The device, according to claim 25, in which the driven shafts are coaxial and are driven in opposite directions.

27. The device, according to claim 26, in which the work head includes at least two work head shafts connected to the second end of the driven shaft.

28. The device, according to claim 27, in which the work head shafts are radially disposed and equidistant from each other.

29. The device, according to claim 27, in which each work head shaft includes a shaft end portion and each surface contact wheel is freely and independently rotatably connected to the work head on the shaft end portion of one of the work head shafts, each work head shaft including two surface contact wheels spaced apart from each other and freely and independently rotatably connected to the shaft end portion thereof.

30. The device, according to claim 29, in which each driven shaft has a generally vertical axis of rotation and the surface contact wheels each have an axis of rotation generally orthogonal to the axis of rotation of the driven shaft.

31. The device, according to claim 30, in which the surface contact wheels include a plurality of circumferentially disposed teeth.

32. The device, according to claim 31, in which the teeth have smooth rounded edges.

* * * * *